US005092371A

United States Patent [19]

Vandeputte

[11] Patent Number: 5,092,371

[45] Date of Patent: Mar. 3, 1992

[54] FASTENING FOR A TEMPLE IN A WEAVING MACHINE

[75] Inventor: Etienne Vandeputte, Ieper, Belgium

[73] Assignee: Picanol N.V., Ieper, Belgium

[21] Appl. No.: 618,616

[22] Filed: Nov. 27, 1990

[30] Foreign Application Priority Data

Nov. 27, 1989 [BE] Belgium ..... 8901262

[51] Int. Cl.[5] ..... D03J 1/22

[52] U.S. Cl. ..... 139/298

[58] Field of Search ..... 139/298, 299, 300, 301

[56] References Cited

U.S. PATENT DOCUMENTS

| | | | |
|---|---|---|---|
| 237,169 | 2/1881 | Cocker | 139/298 |
| 3,258,037 | 6/1966 | Brown | 139/298 |
| 3,800,835 | 4/1974 | Riha et al. | 139/298 |

FOREIGN PATENT DOCUMENTS

| | | |
|---|---|---|
| 846973 | 10/1976 | Belgium . |
| 530994 | 8/1931 | Fed. Rep. of Germany . |
| 2335630 | 7/1977 | France . |
| 5206 | 6/1913 | United Kingdom . |

*Primary Examiner*—Andrew M. Falik
*Attorney, Agent, or Firm*—Bacon & Thomas

[57] ABSTRACT

A support system for a temple arranged to hold and stretch the edge of woven fabric in a weaving machine wherein the temple includes a plurality of guide rings and an end guide ring located approximately at the edge area of the woven fabric. The support system includes an end support for rotatably holding the temple above the edge area of the woven fabric and which is integrated with an intersects the end guide ring of the temple from above the temple. A second support for supporting the temple from above is located spaced away from the end guide ring and includes a clamp for restraining the temple against rotation relative to the end support. The location of the end support relative to end guide ring leaves the fabric edge free from mechanical interference with the temple support. The temple support also includes position adjusting systems for adjusting the position of the temple relative to the weaving machine in a direction towards and away from the plane of the woven fabric, along the weaving width of the machine and in directions parallel to the woven fabric.

22 Claims, 5 Drawing Sheets

Fig. 14
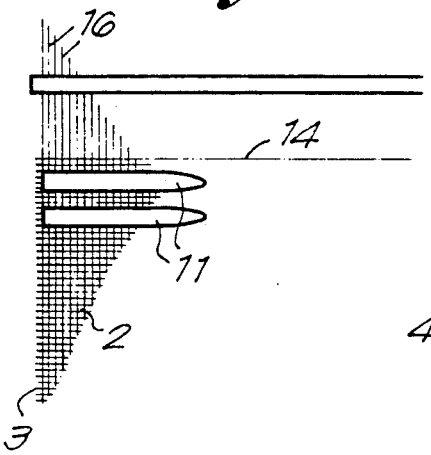
Fig. 15
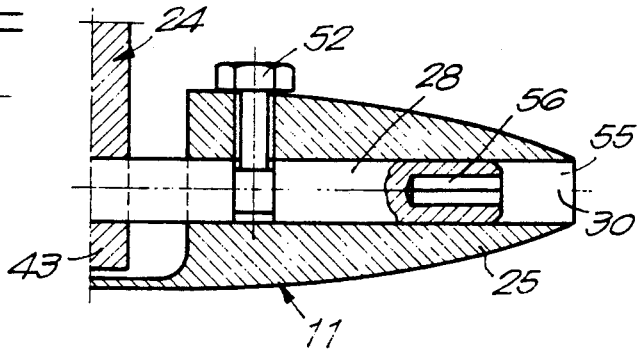
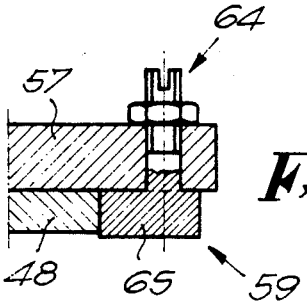
Fig. 16
Fig. 17
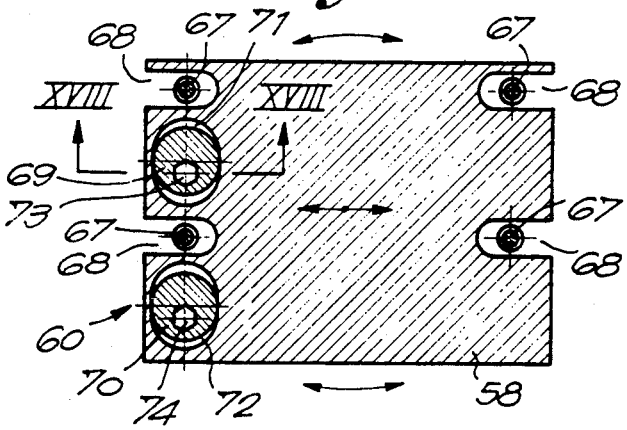
Fig. 18
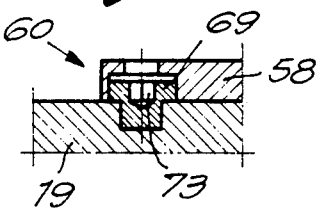
Fig. 19
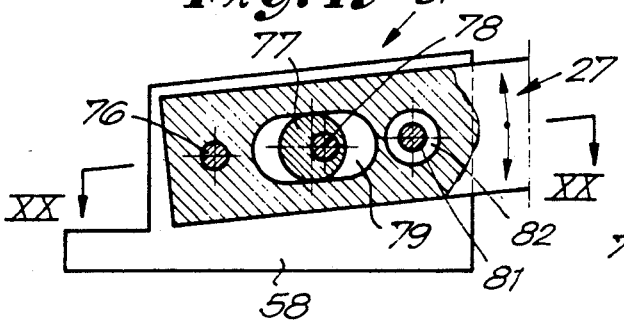
Fig. 20
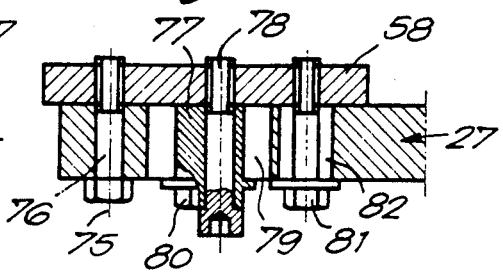

FASTENING FOR A TEMPLE IN A WEAVING MACHINE

BACKGROUND OF THE INVENTION

1. Field of the Invention

This invention concerns a fastening for a temple in a weaving machine.

2. Related Art and Technology

It is known that most fabrics during their manufacture tend to contract crosswise. However, in order to insert new weft threads correctly in the shed, it is necessary that the fabric be stretched crosswise at the stop (be up) line, which in practice is done by means of temples.

In practice, two types of temples are essentially used. On the one hand, two temples with a limited length can be used which exert a traction on the edges of both sides of the fabric. On the other hand it is also known to use one temple which stretches the fabric over its entire width. The present invention concerns a fastening for a temple of the first type.

The temples of the first type mentioned above are usually fastened to the weaving machine by means of two supports. According to a first known possibility one end of the temple is screwed to a support situated next to the fabric edge by means of a nut, and the other end, above the fabric, is hung on a support. This embodiment has the disadvantage that there remains little space for mounting a weft cutter, waste cutter or any other part above the fabric edge, on the one hand because the support is situated next to the fabric edge, and on the other hand because this space is occupied by the bolt end of the temple and the nut screwed on it.

According to a second known possibility the temple is supported on the one hand in the middle, and on the other hand near the end pointing away from the fabric edge. This has the advantage that there are no supports or similar above the fabric edge, which, for example, is desirable in case the weaving machine is provided with a tucking-in device which must be able to cooperate in conjunction with the edge of the fabric. However, such a temple has the disadvantage that it provides two stretching zones, as a result of which, in the case of sensitive fabrics, a line may be formed in the fabric in the warp direction above the of transition between a stretching zone and a non-stretched zone.

BRIEF SUMMARY OF THE INVENTION

The present invention concerns a fastening for a temple in a weaving machine, whereby none of the disadvantages mentioned above occurs. To this end it concerns a fastening for a temple in a weaving machine, in particular a temple of the type meant to hold the edge of the fabric, wherein the fastening essentially consists of a first support disposed above the fabric edge, with the temple mounted in this first support such that it can rotate freely; a second support near the top of the temple; and, above the second support, means are provided which clamp the temple in relation to the second support.

In the most preferred embodiment, the fastening for a temple in a weaving machine, particularly for a temple of the type meant to hold the edge of a fabric, is characterized in that the fastening essentially consists of a first support located above the fabric edge for mounting the temple such that it can rotate freely, with this first support built into the end guide of the temple and intersecting the end guide; a second support near the top of the temple, and at the height of the second support, means for clamping the temple against rotation in relation to the second support.

BRIEF DESCRIPTION OF THE DRAWINGS

In order to better explain the characteristics of the invention, by way of example only and without being limitative in any way, the following preferred embodiments are described with reference to the accompanying drawings, where:

FIG. 14 shows a schematic view for a variant, corresponding to the view according to FIG. 5;

FIG. 15 shows a variant of the part indicated in FIG. 7 by F15;

FIGS. 16 and 17 show cross-sections, respectively according to lines XVI—XVI and XVII—XVII in FIG. 4;

FIG. 18 shows a cross-section according to line XVIII—XVIII in FIG. 17;

FIG. 19 shows a cross-section according to line XIX—XIX in FIG. 4;

FIG. 20 shows a cross-section according to line XX—XX in FIG. 19.

DETAILED DESCRIPTION

Figure 1:
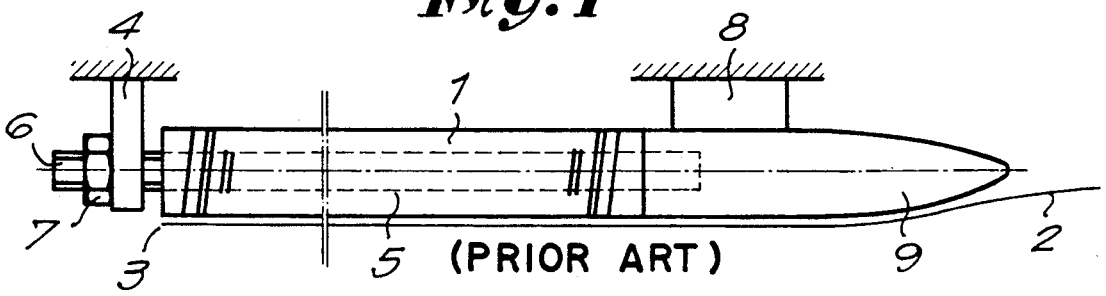
FIGS. 1 and 2 show schematic representations of fastenings for a temple which are known from the state of the art.

FIG. 1 shows an embodiment, according to the state of the art, for fastening a temple 1 above a fabric 2. Hereby the temple 1 is hung, on the one hand, on a support 4 situated next to the fabric edge 3, this support for to this support 4 by means of a screw thread end 6 which is formed on the temple shaft 5 and upon which a nut 7 is screwed, and on the other hand on a support 8 which is situated at the top of nose piece 9. It is clear that the support 4, the screw thread end 6 and the nut 7 impede the mounting of a weft cutter or other weaving machine parts next to the fabric edge 3.

Figure 2:
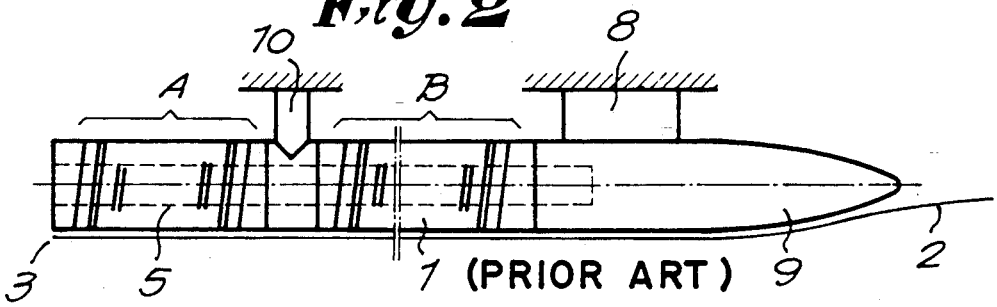

FIG. 2 shows a known embodiment which does not have the disadvantage of the embodiment of FIG. 1, i.e., the support 4 is replaced by a support 10 which is situated in the middle of the temple 1. However, this solution has the disadvantage that two stretching zones A and B are created, which in the case of sensitive fabrics may lead to the formation of fabric lines above the support 10 in the fabric 2, in a warp direction.

The present invention concerns a fastening which does not have any of the disadvantages mentioned above.

Figure 3:
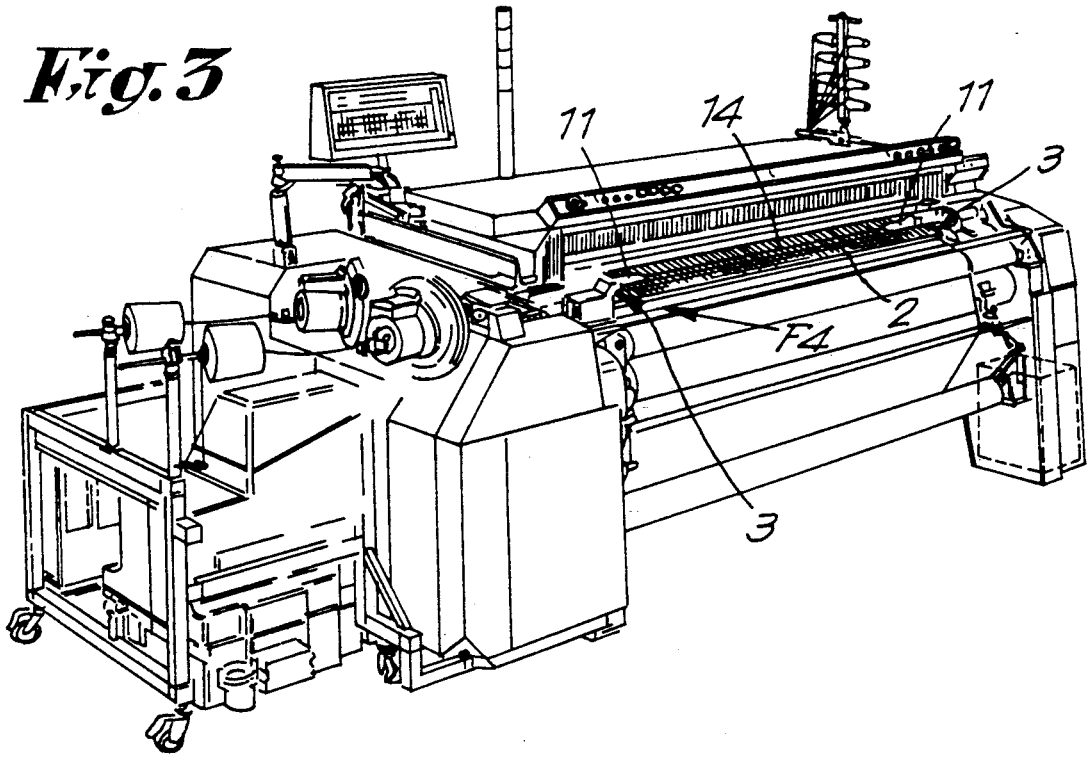
FIG. 3 shows a weaving machine in which this invention is applied.

FIG. 3 shows the environment of the invention in the weaving machine. The present invention concerns a fastening for temples 11 of the type which exerts a traction on the fabric edges 3 of the fabric 2. As is conventional, as shown in FIGS. 4 and 5, such temples 11 have a cylindrical form, whereby a number, for example twenty, of rings 12 are mounted on the temple recessed from the mantle surface, and these rings are usually provided with needles 13 at their outer surface.

Figure 6:
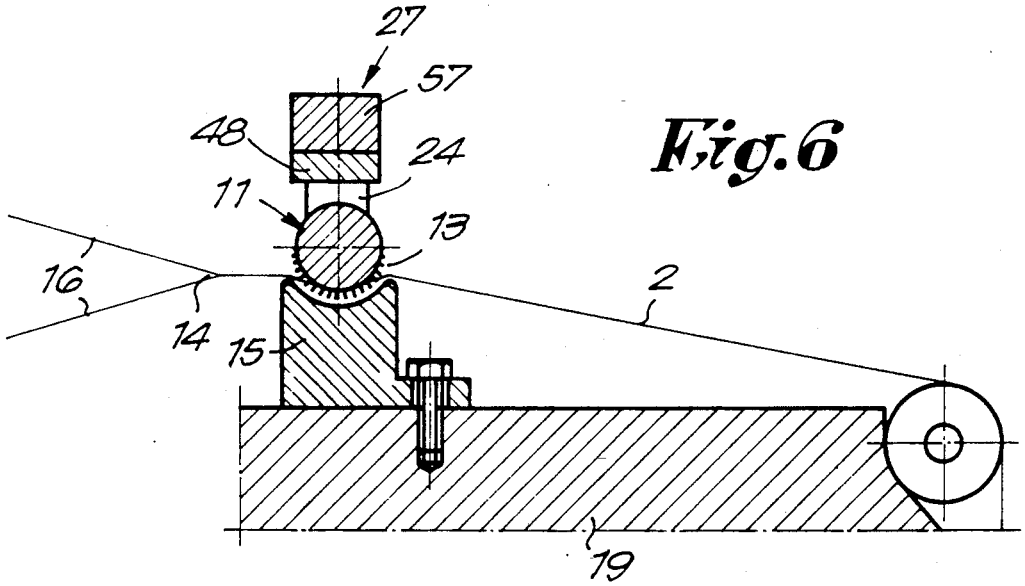
FIG. 6 shows a cross-section according to line VI—VI in FIG. 4.

As indicated in FIG. 6 the fabric 2 is guided over a gutter-shaped fabric guide 15 a short distance from the stop (bead-up) line 14, whereby the fabric is pressed by the temples 11, into the gutter-shape by these temples 11. The above-mentioned rings 12 are mounted such that, on the one hand, they can make an eccentric movement in relation to the actual mantle of the temple 11, such that the needles 13 are presented either more or less further from the temple 11 as a function of their place on the ring periphery, and on the other hand the rings 12 are aslant in relation to the plane of the fabric 2. As a result, the above-mentioned needles 13 mesh into the fabric 2 when it passes underneath the temple 11 and the rings 12 are rotated along by the movement of the fabric 2, which in turn results in the needles 12 exerting a sideways traction on the fabric 2. By setting the temple 11 under a different angle, the mesh of the needles 13 can be changed, an action that can be executed by the weaver as a function of the fabric to be produced.

Figure 4:
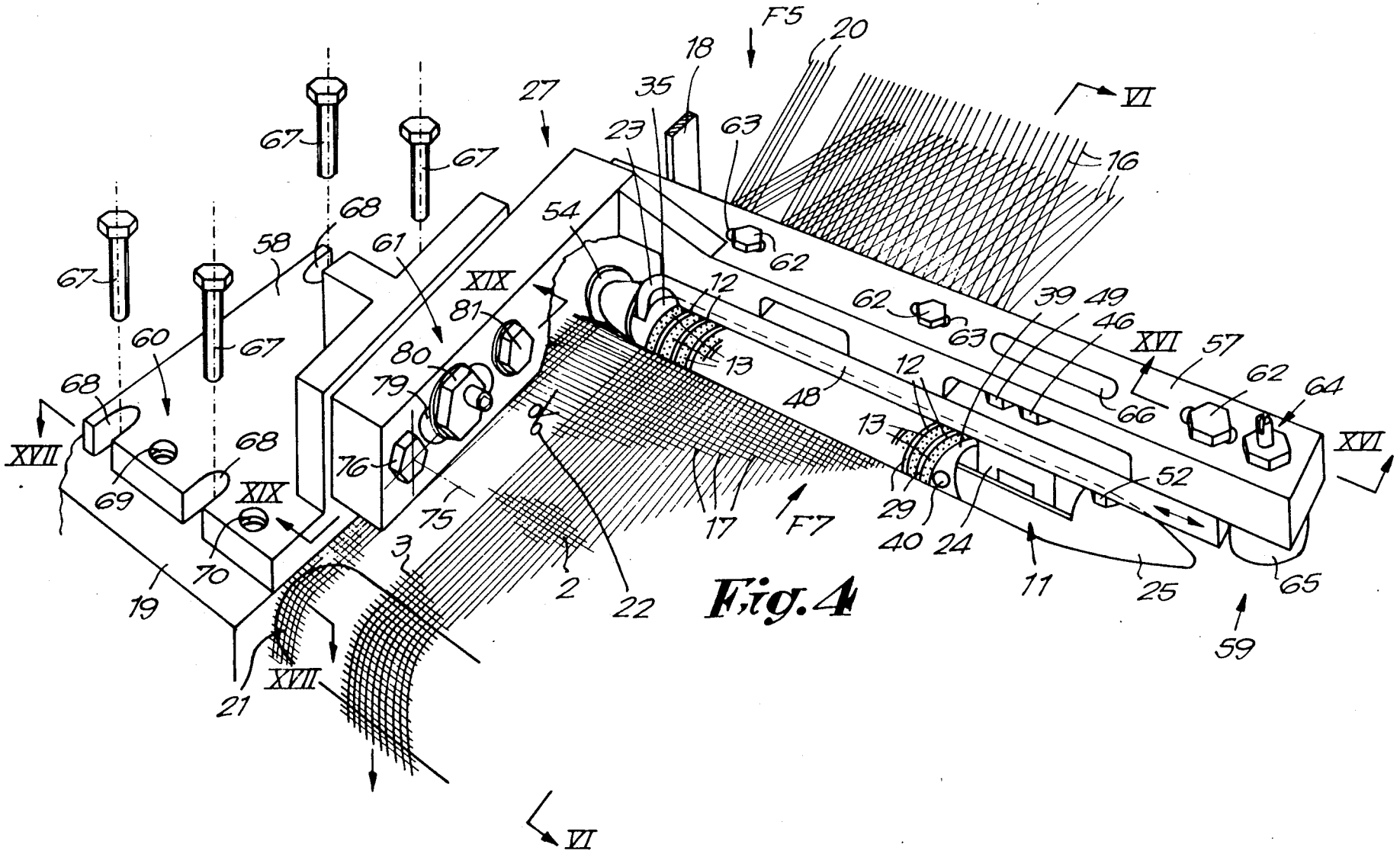
FIG. 4 shows a view of the part indicated in FIG. 3 by F4, to a greater scale.
Figure 5:
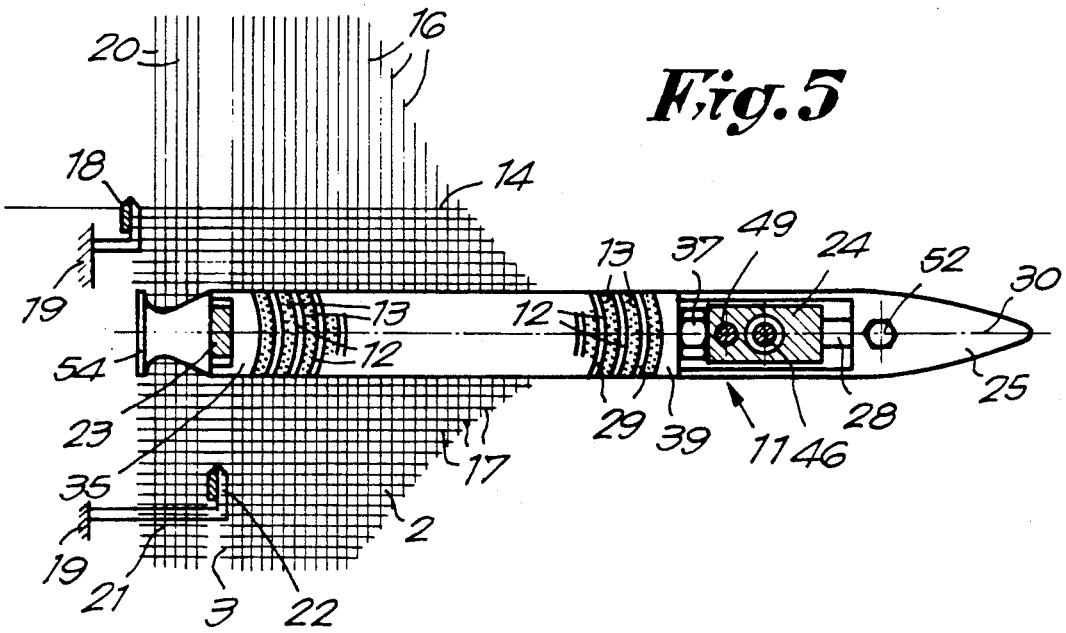
FIG. 5 shows a view according to arrow F5 in FIG. 4.

By way of illustration, in FIGS. 4 and/or 5 a number of other components are indicated, such as the warp threads 16, the weft threads 17, the weft cutter 18 and the frame 19 of the weaving machine. In case catch cords 20 are used to hold newly inserted weft threads 17 at an end, the formed waste ribbon 21 of the fabric 2 is cut by means of a waste cutter 22.

The present invention is unique in that the fastening of the temple 11 is essentially formed by a first support 23 above the fabric edge 3, whereby the temple 11 is mounted so that it can rotate; a second support 24 is provided near the top 25 of the temple 11; and above the second support 24, means 26 (FIG. 7) are provided which clamp the temple 11 in relation to this second support 24. The supports 23 and 24 are connected with the frame 19 of the weaving machine, for example by means of a number of supporting means 27 (FIG. 4) which are further specified below.

Figures 7, 8, 9, 10, 11:
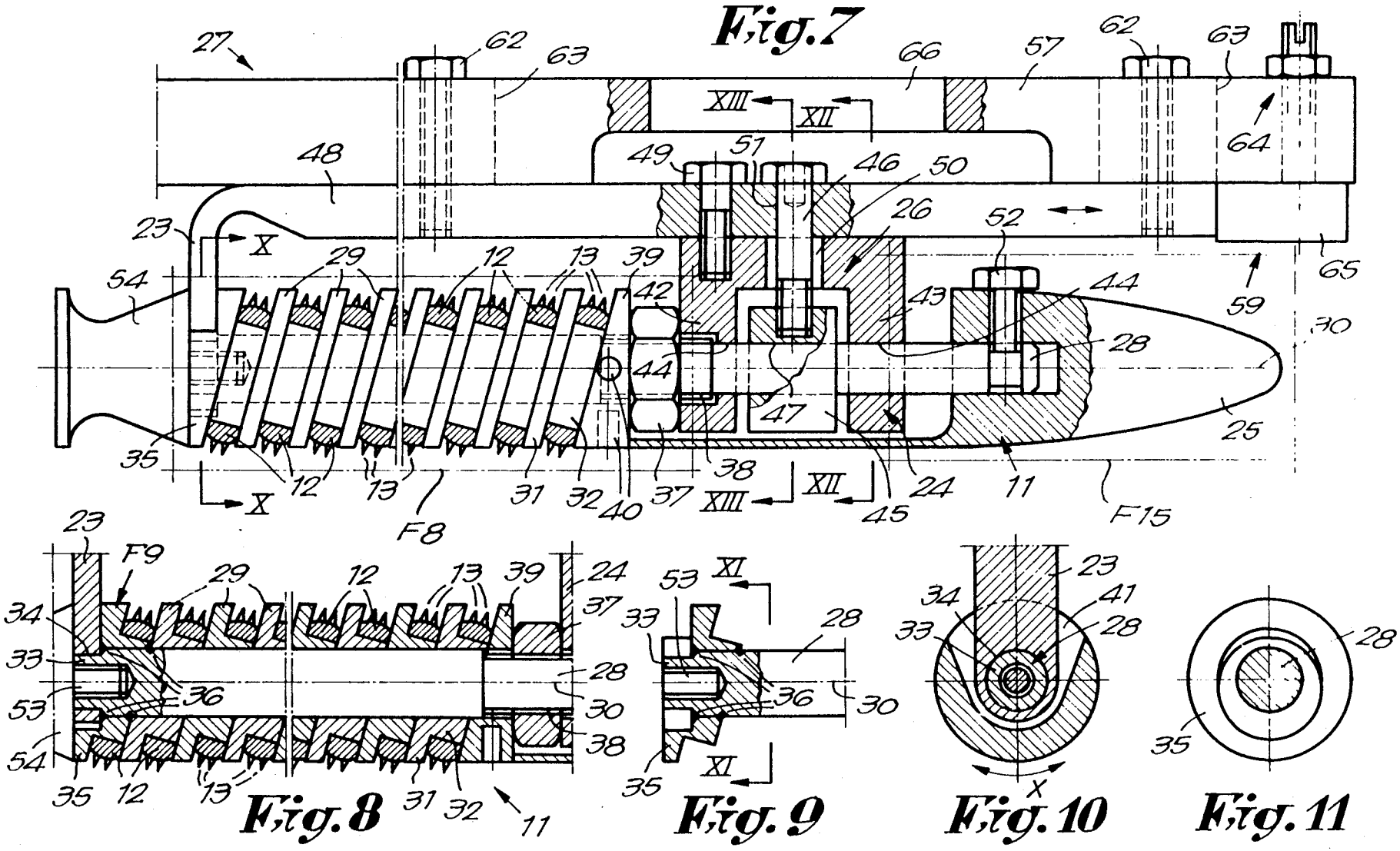
FIG. 7 shows a view according to arrow F7 in FIG. 4, partly in cross-section.
FIG. 8 shows a cross-section of the part indicated in FIG. 7 by F8.
FIG. 9 shows the part indicated in FIG. 8 by F9, dismantled.
FIG. 10 shows a cross-section according to line X—X in FIG. 7.
FIG. 11 shows a cross-section according to line XI—XI in FIG. 9.

As indicated in FIGS. 7 and 8 the temple 11 has a temple shaft 28 which acts as pivot for a number of ring-shaped guides 29 over which the rings 12 mentioned above can be rotated. The guides 29 are aslant in relation to the axial shaft 30 of the temple 11 and each have a part 31 with a large diameter, which is meant to separate the rings 12 sideways from each other, and a part 32 with a smaller diameter over which the rings 12 can rotate rather freely.

According to the present invention the temple 11 is mounted such in the first support 23 that it can rotate freely. To this end (see FIG. 10) the temple shaft 28 has a smooth shaft part 33 which fits into a bore 34 in the above-mentioned support 23, whereby the end of this shaft part 33 is almost coextensive with the outside of the first support 23 or is situated within this first support 23. Preferably, the first support 23 intersects and is integrated into the end guide 35 of the temple 11, such that the first support 23 extends only a little or not at all beyond the fabric edge 3, such that next to the first support 23 space remains available to mount other desired weaving machine parts next to the fabric edge 3. In order for the first support 23 to be integrated into the end guide 35, the latter is preferably made in one piece with the temple shaft 28 and may to this end, as indicated in FIG. 8, be attached to it by means of one or more weldings 36. This allows the other guides 29 to be tightened against the end guide 35 by means of a nut 37 which can rotate over the screw thread 38 applied to the temple shaft 28. In front of the nut 37 a lock block 39 is applied which is provided with at least one radial recess 40, in which a tool can be applied to turn the temple 11. The recess 40 may be situated in any of the parts rotating with the temple shaft 28.

In order to ensure that the first support 23 is recessed into the end guide 35, a recess 41 is applied in this end guide 35, as indicated in FIG. 10. The recess 41 is preferably V-shaped and has such dimensions that a sufficiently large latitude is offered to enable the temple 11 to be rotated in both directions over a well-defined angle, as indicated by arrow X.

FIG. 11 further illustrates the preferred form of the end guide 35.

As show in FIG. 7 the above-mentioned second support 24 is preferably made in the form of an invented U. Both legs 42 and 43 of the U shape extend radially in relation to the shaft 30 mentioned above, and are each provided with a bore 44, which form passages for the temple shaft 28.

Figure 12:
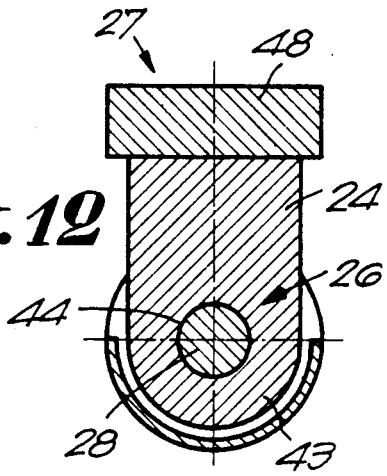
FIGS. 12 and 13 show cross-sections according to lines XII—XII and XIII—XIII in FIG. 7.
Figure 13:
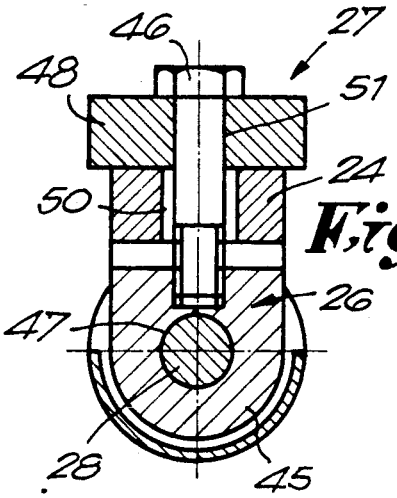

The means 26 which clamp the temple 11 in relation to the second support 24 preferably consist of an element 45 which is situated between the legs 42 and 43 round the temple shaft 28, and screwing means cooperating in conjunction with it, such as a screw 46 which meshes into this element 45, whereby, when the screwing means are tightened, the element 45 is moved radially in relation to the above-mentioned shaft 30, such that the temple shaft 28 is clamped against the side wall of the bores 44 mentioned above, and the side wall of the bore 47 in the element 45. The form of the second support 24 and of the element 45 is further illustrated in FIGS. 12 and 13.

The first support 23 is preferably made in one piece with a first supporting part 48 which extends horizontally over the temple 11, while the second support 24 is screwed down by means of a screw 49 or similar. The above-mentioned screw 46 which is screwed into the element 45 passes freely through an opening 50 in the second support 24 and an opening 51 in the supporting part 48 in which the screw 46 rests. This has the advantage that the means 26 to clamp the temple 11 in a well-defined angle position are easily accessible.

The top 25 of the temple 11 is formed by a conical covering piece which is adjustably attached to the temple shaft 28 by means of screwing means such as a screw 52 or similar which clamps top 25 shaft 28.

As indicated in FIGS. 8 and 9, it is also possible to provide screwing means 53 in the shaft part 33, such as a bore with screw thread, and in which a waste guide element 54 is provided, as indicated in FIGS. 4, 5 and 7.

In case two temples are mounted at one fabric edge, as represented schematically in FIG. 14, the recess 40 as shown in FIG. 7 is not accessible. At least for the temple 11 situated nearest to the bead-up line 14, an embodiment with a top 25 as shown in FIG. 15 is preferably used, whereby an axial opening 55 runs through this top 25 and whereby, in the crosscut end of the temple shaft 28 at the height of the top 25, a recess 56 is provided in which a tool such as a socket head wrench or similar fits, such that the temple 11 can be turned from the top.

The whole is preferably combined with supporting means 27, which allow a number of additional adjustments, particularly the motion of the temple 11 in relation to the fabric 2. To this end are preferably used, as indicated in FIG. 4, a first supporting part 48 as mentioned above, a second supporting part 57 under which the first supporting part 48 is mounted, and a third supporting part 58 which on the one hand is attached to the frame 19 and on the other hand supports the second supporting part 57. These supporting parts 48, 57 and 58 contain means 59 which allow the temple 11 to be moved in an axial direction; means 60 which allow the temple 11 to be moved in a plane parallel or almost parallel to the fabric 2, and means 61 which allow the temple 11 to be moved essentially perpendicular to the plane of the fabric 2 and/or to be turned over a small angle.

Means 59 make sure that the first supporting part 48 can be moved laterally weft wise in relation to the second supporting part 57. To this end the first supporting part 48 is screwed onto the second supporting part 57 by means of screws 62. As shown in FIGS. 4 and 7, the screws 62 pass along the upper side through grooves 63 in the second supporting part 57. By unscrewing the screws 62, the first supporting part 48 can be moved, and consequently the temple 11 can be positioned in relation to the fabric edge 3. An exact setting is possible by making use of a setting cam 65 which can be turned by means of screwing means 64 and which is attached to the second supporting part 57 and which meshes into the supporting part 48, as shown in FIGS. 4, 7 and 16.

It must be noted that the heads of the screws 46 and 49 are surrounded by a second supporting part 57. At the top of these screws 46 and 49 a groove 66 is therefore provided in the second supporting part 57, such that at least the screw 46, regardless of the position of the first supporting part 48, is always accessible and can be reversibly rotated, for example by means of a socket head wrench. The screws 46 and 49 are also accessible from the side.

FIGS. 17 and 18 show a practical embodiment of the means 60 mentioned above. These means provide a fastening of the third supporting part 58 on the frame 19, such that this third supporting part 58 can be moved in a plane parallel or almost parallel to the fabric. The third supporting part 58 can be screwed onto the frame 19 by means of screws 67. The passages 68 applied in the third supporting part 58 consist at least of grooves which extend parallel to the fabric edge 3, and are preferably made with a sufficiently large latitude in relation to the screws 67, such that a small rotational movement of the third supporting part 58 is possible. In the frame 19 two adjusting cams 69 and 70 are mounted according to the weaving width next to each other, and which mesh into the openings 71 and 72 in the third supporting part 58. The adjusting cams 69 and 70 are hereby situated eccentrically in relation to their pivot shafts, such that the third supporting part 58 is moved by their turning. In order to turn the adjusting cams 69 and 70 they are preferably provided with axially directed hexagonal openings 73 and 74 in which a socket head wrench fits.

It is clear that by the simultaneous turning of both adjusting cams 69 and 70, the temple 11 can be moved parallel to the stop bead-up line, so that it can be taken as closely to the stop line 14 as possible, while the parallelism to the stop line 14 can be set by a mutual turning of the adjusting cams 69 and 70. Once the whole has been set, the third supporting part 58 is tightened by means of screws 67.

The above-mentioned means 61 for setting the height of the temple 11 consist in the embodiment shown of a hingeable fastening of the second supporting parts 57 to the third supporting part 58, whereby the second supporting part 57 can rotate round a pivot shaft 75 which extends parallel to the weaving width, as shown in FIGS. 4, 19 and 20. The hingeable fastening can be formed by a screw 76, whereby the setting is done by means of an adjusting cam 77 which can be rotated by means of a pivot shaft 78 mounted in the third supporting part 58, and which at its outlines works in conjunction with a groove 79 made in the second supporting part 57 and directed essentially radially in relation to the pivot shaft 75. The pivot shaft 78 is preferably formed by a screw stretching through the adjusting cam 77. The adjusting cam 77 is in turn provided with a screw head 80, so that it can be turned round the screw 78. Further an additional screw 81 can be provided which fits, with great latitude, into an opening 82 in the second supporting part 57, such that a well-defined angle rotation of the second supporting part 57 round the pivot shaft 75 is possible. It is clear that, in order to rotate the second supporting part 57, the screws 76, 78 and 81 must be unscrewed a little, after which the adjusting cam 77 must be turned by means of a wrench placed on the screw head 80, so that subsequently, when the whole is properly set, the three above-mentioned screws can be tightened again. This setting permits adjustment of the downward force on the fabric, and the use temples 11 with different diameters.

The working of the device can easily be deduced from the figures. The setting is done by means of the above-mentioned means 59, 60 and 61. The meshing of the needles 13 into the fabric can be changed by the fastening according to the invention simply by unscrewing screw 46 and then turning the temple 11 by means of a socket head wrench or similar in either of the recesses 40 or 56, until the temple 11 is presented to the fabric 2 with a side where the needles 13 protrude from the mantle of the temple 11 up to the desired height.

The present invention is in no way limited to the embodiments described by way of example and shown in the drawings; on the contrary, such a fastening for a temple in weaving machines can be made in several variants while still remaining within the scope of the invention.

I claim:

1. In a weaving machine including a temple for stretching an edge of woven fabric and a support for supporting the temple from above the fabric, said temple including guide rings and an end guide ring located at the fabric edge area, the improvement comprising:

said temple support comprising a first support rotatably connected to one end area of the temple from a position above the temple and intersecting said end guide ring;

a second support connected to the temple from a position above the temple at a location separated from said one end area;

and means associated with the second support for locking the temple against rotation relative to the first support.

2. The improvement as claimed in claim 1, wherein said temple includes a temple shaft supporting the guide rings; said end guide ring is rigidly affixed to said shaft; means for clamping said guide rings against said end guide ring; said shaft including a threaded portion remote from said end guide ring; said clamping means comprising a nut threaded on said threaded portion and movable towards and away from the end guide ring upon rotation of the nut in opposite directions.

3. The improvement as claimed in claim 1, wherein said end guide ring includes a "V" shaped recess having end walls facing said first support; said first support intersecting said end guide ring at said recess so that the end guide ring may rotate relative to said first support within the limits of the end walls of said recess.

4. The improvement as claimed in claim 1, wherein said temple includes a temple shaft supporting the guide rings and said end guide ring is affixed to said shaft; said shaft rotatably supported relative to and terminating at the first support.

5. The improvement as claimed in claim 4, said shaft including a threaded aperture at its terminal end located at the first support.

6. The improvement as claimed in claim 5, said second support including a shaft receiving seat; said shaft intersecting said second support at said seat; and said means for adjustably locking the temple against rotation comprising clamping means for locking the shaft to said seat against rotation at various desired angular relationships between the shaft and its seat.

7. The improvement as claimed in claim 6, said shaft securing seat comprising an aperture in said second support; said clamping means comprising a block having an aperture and a threaded member connected to the block; said shaft extending through the block aperture; rotation of said threaded member causing radial movement of the block relative to the shaft; said block located adjacent said aperture in said second support, whereby rotation of said threaded member radially moves the shaft against a wall of the aperture in the second support.

8. The improvement as claimed in claim 7, said second support being bifurcated and including shaft receiving apertures in each bifurcated portion; and wherein said block is disposed between the bifurcated portions.

9. The improvement as claimed in claim 7, wherein said threaded member is supported by a third support that is connected to the second support.

10. The improvement as claimed in claim 1, wherein said temple includes a temple shaft supporting the guide rings; and shaft rotation means for enabling the shaft to be rotated, said rotation means comprising a turning element engaging the shaft and a radial recess in said turning element for receiving a turning implement.

11. The improvement as claimed in claim 1, wherein said temple includes a temple shaft supporting the guide rings, said shaft including a shaft end located at an end area of the temple opposite the first support location; and shaft rotation means for enabling the shaft to be rotated, said rotation means comprising a longitudinal recess in the shaft end for receiving a shaft turning implement.

12. The improvement as claimed in claim 1, wherein said temple includes a temple shaft supporting the guide rings, said temple including a top member secured to said shaft by a clamp member including means for locking the top member to the shaft at various rotational positions.

13. The improvement as claimed in claim 1, including means for securing the temple support to the weaving machine, said securing means including axial moving means for adjusting the position of the temple axially along the temple longitudinal axis along the woven fabric width.

14. The improvement as claimed in claim 12, said axial moving means comprising a first securing member (57) attached to the weaving machine; a second securing member (48) moveably carried by the first securing member; said first and second supports (23,24) for the temple (11) connected to and carried by said second securing member; a cam adjuster (65) carried by one of said first and second securing members; and a cam follower carried by the other of said first and second securing members; said cam adjuster and cam follower arranged to cooperate so that rotation of the cam adjuster causes axial movement of the second securing member relative to the first securing member; and means for releasably locking said first and second securing members against relative movement.

15. The improvement as claimed in claim 1, including means for securing the temple support to the weaving machine, said securing means including vertical moving means for adjusting the position of the temple vertically towards and away from the woven fabric.

16. The improvement as claimed in claim 15, wherein said securing means comprises a first portion (57) arranged to support said first and second supports (23,24) for the temple (11); a second securing member (58) connected to the weaving machine; said first support including a second portion (61) arranged to interconnect said first and second securing members; said vertical moving means disposed between said second portion and the second securing member and including means for vertically moving said first and second securing members relative to each other.

17. The improvement as claimed in claim 16, said second securing member and second portion pivotally connected for relative rotation about a pivot axis (75) extending along the weaving width; said vertical moving means comprising a cam and follower (77,79) adjuster arranged to pivot the first supporting member about said pivot axis when the cam is moved for vertical adjustment of the first securing member.

18. The improvement as claimed in claim 1, including means for securing the temple support to the weaving machine, said securing means including horizontal moving means for adjusting the position of the temple at least parallel to the woven fabric along the weft direction.

19. The improvement as claimed in claim 18, wherein said securing means comprises a first securing member (57) arranged to support said first and second supports for the temple; and a second securing member (58) arranged to adjustably attach said first securing member to the weaving machine; said horizontal moving means comprising a cam and follower means (69, 70, 71, 72) associated with the second securing member for moving said second securing member relative to the weaving machine in a direction parallel to the woven fabric when the cam means is moved in a horizontal adjusting direction.

20. The improvement as claimed in claim 19, said cam and follower means including means for moving the second securing member along the warp direction of the fabric and for pivoting the second securing member in a plane parallel to the fabric plane.

21. The improvement as claimed in claim 1, including means for securing the first and second temple supports to the weaving machine; said securing means including means for adjusting the position of the temple supports vertically towards and away from the woven fabric, parallel to the fabric along the weaving width, and horizontally parallel to the fabric along the fabric weft; said securing means comprising adjustable cams and followers; and clamping means for fixing the securing means relative to the weaving machine.

22. The improvement as claimed in claim 21, said securing means including means for adjusting the rotational position of the temple supports in a plane parallel to the fabric.

* * * * *